US012369633B2

(12) United States Patent
Park

(10) Patent No.: US 12,369,633 B2
(45) Date of Patent: Jul. 29, 2025

(54) AEROSOL-GENERATING APPARATUS

(71) Applicant: KT&G CORPORATION, Daejeon (KR)

(72) Inventor: Ju Eon Park, Seoul (KR)

(73) Assignee: KT&G CORPORATION, Daejeon (KR)

( * ) Notice: Subject to any disclaimer, the term of this patent is extended or adjusted under 35 U.S.C. 154(b) by 660 days.

(21) Appl. No.: 17/597,348

(22) PCT Filed: Aug. 6, 2021

(86) PCT No.: PCT/KR2021/010397
§ 371 (c)(1),
(2) Date: Jan. 4, 2022

(87) PCT Pub. No.: WO2022/065677
PCT Pub. Date: Mar. 31, 2022

(65) Prior Publication Data

US 2023/0346024 A1 Nov. 2, 2023

(30) Foreign Application Priority Data

Sep. 23, 2020 (KR) ..... 10-2020-0123327

(51) Int. Cl.
*A24F 40/46* (2020.01)
*A24F 40/42* (2020.01)
(Continued)

(52) U.S. Cl.
CPC ..... *A24F 40/46* (2020.01); *A24F 40/42* (2020.01); *A24F 40/51* (2020.01); *A24F 40/57* (2020.01)

(58) Field of Classification Search
None
See application file for complete search history.

(56) References Cited

U.S. PATENT DOCUMENTS 4,677,995 A * 7/1987 Kallianos ..... A24D 3/041 131/338
11,178,910 B2 11/2021 Kim et al.
(Continued)

FOREIGN PATENT DOCUMENTS

CN 110325059 A 10/2019
CN 110494054 A 11/2019
(Continued)

OTHER PUBLICATIONS

KR20210100405A, Aerosol delivering device and aerosol generating device with the same, (Year: 2021).*
(Continued)

*Primary Examiner* — Michael J Felton
(74) *Attorney, Agent, or Firm* — Sughrue Mion, PLLC

(57) ABSTRACT

An aerosol-generating apparatus includes a vaporizer configured to generate an aerosol by heating an aerosol-generating material, a chamber configured to rotate with respect to the vaporizer and store a flavoring material such that the aerosol generated in the vaporizer passes through the flavoring material, an input portion configured to rotate according to a user manipulation and cause the chamber to rotate along, an input circuit including a rotating device coupled to the input portion to rotate with the input portion, and a plurality of connecting devices configured to generate a signal based on a position of the rotating device such that one of the plurality of connecting devices corresponding to a position of the rotating device generates a changed signal, and a processor configured to perform a function corresponding to a connecting device that has generated the changed signal among the plurality of connecting devices.

14 Claims, 7 Drawing Sheets

(51) Int. Cl.
*A24F 40/51* (2020.01)
*A24F 40/57* (2020.01)

(56) References Cited

U.S. PATENT DOCUMENTS

| | | | | |
|---|---|---|---|---|
| 2010/0006113 | A1 | 1/2010 | Urtsev et al. | |
| 2011/0036363 | A1 | 2/2011 | Urtsev et al. | |
| 2016/0205998 | A1 | 7/2016 | Matsumoto et al. | |
| 2017/0048930 | A1* | 2/2017 | Marsh | B65B 3/04 |
| 2018/0007965 | A1* | 1/2018 | Karles | A61M 11/042 |
| 2018/0025864 | A1 | 1/2018 | Katsuraku et al. | |
| 2019/0001087 | A1 | 1/2019 | Davidson et al. | |
| 2020/0113232 | A1 | 4/2020 | Bless et al. | |
| 2020/0120977 | A1 | 4/2020 | Bless et al. | |
| 2020/0163380 | A1 | 5/2020 | Lee et al. | |
| 2020/0205473 | A1 | 7/2020 | Ewing et al. | |
| 2020/0359682 | A1 | 11/2020 | Han et al. | |
| 2021/0000185 | A1 | 1/2021 | Jung et al. | |
| 2021/0127748 | A1 | 5/2021 | Lim et al. | |

FOREIGN PATENT DOCUMENTS

| | | | | |
|---|---|---|---|---|
| CN | 111329110 | A | 6/2020 | |
| CN | 111685394 | A | 9/2020 | |
| EP | 2 989 912 | A1 | 3/2016 | |
| EP | 3491945 | A1 * | 6/2019 | A24B 15/12 |
| JP | 2010-508034 | A | 3/2010 | |
| JP | 2011-518638 | A | 6/2011 | |
| JP | 2017-35097 | A | 2/2017 | |
| JP | 2019-41736 | A | 3/2019 | |
| JP | 2020-516262 | A | 6/2020 | |
| KR | 10-2001-0036032 | A | 5/2001 | |
| KR | 10-2018-0103960 | A | 9/2018 | |
| KR | 10-2019-0049647 | A | 5/2019 | |
| KR | 10-2020-0057488 | A | 5/2020 | |
| WO | 2015/052192 | A1 | 4/2015 | |
| WO | WO-2017056103 | A1 * | 4/2017 | A24F 40/50 |
| WO | 2017/086023 | A1 | 5/2017 | |
| WO | 2018/109696 | A1 | 6/2018 | |
| WO | 2020/176519 | A1 | 9/2020 | |
| WO | 2020/183171 | A1 | 9/2020 | |

OTHER PUBLICATIONS

EP3491945A1, Flavor Inhaler, (Year: 2019).*
Communication dated Mar. 7, 2023, issued in Japanese Application No. 2022-508958.
Extended European Search Report dated Jul. 11, 2022, issued in European Application No. 21834699.7.
International Search Report for PCT/KR2021/010397 dated Nov. 11, 2021 [PCT/ISA/210].
Written Opinion for PCT/KR2021/010397 dated Nov. 11, 2021 [PCT/ISA/237].
Office Action issued Dec. 26, 2024 in Chinese Patent Application No. 202180006192.5.

* cited by examiner

AEROSOL-GENERATING APPARATUS

CROSS REFERENCE TO RELATED APPLICATIONS

This application is a National Stage of International Application No. PCT/KR2021/010397 filed Aug. 6, 2021, claiming priority based on Korean Patent Application No. 10-2020-0123327 filed Sep. 23, 2020.

TECHNICAL FIELD

Embodiments relate to an aerosol-generating apparatus, and more particularly, to an aerosol-generating apparatus configured to perform various functions in response to user inputs.

BACKGROUND ART

Recently, there is an increasing demand for an aerosol-generating apparatus for generating an aerosol in a non-combustion method, instead of generating aerosols by combusting a general aerosol-generating article. For example, studies have been conducted on an aerosol-generating apparatus configured to generate aerosols by a non-combustion method from an aerosol-generating material or provide aerosols with flavors by passing the aerosols, which are generated from the aerosol-generating material, through a flavoring medium.

DISCLOSURE

Technical Problem

There is a need for an aerosol-generating apparatus that provides a convenient user interface that allows a user to easily control various functions of the aerosol-generating apparatus. Technical problems to be addressed by the embodiments are not limited thereto, and other technical problems may be derived from the following embodiments.

Technical Solution

According to an aspect, an aerosol-generating apparatus includes: a vaporizer configured to generate an aerosol by heating an aerosol-generating material; a chamber configured to rotate with respect to the vaporizer and store a flavoring material such that the aerosol generated in the vaporizer passes through the flavoring material; an input portion configured to rotate according to a user manipulation and cause the chamber to rotate along; an input circuit comprising: a rotating device coupled to the input portion to rotate with the input portion; and a plurality of connecting devices configured to generate a signal based on a position of the rotating device such that one of the plurality of connecting devices corresponding to a position of the rotating device generates a changed signal; and a processor configured to perform a function corresponding to a connecting device that has generated the changed signal among the plurality of connecting devices.

Advantageous Effects

An aerosol-generating apparatus may perform various functions based on inputs of a user who uses the aerosol-generating apparatus, thereby providing satisfaction and convenience to the user. In addition, the aerosol-generating apparatus may increase a duration of migration of flavoring materials by using at least one chamber.

Advantageous effects of the present disclosure are not limited the above-stated effects, and effects that are not mentioned may be clearly understood by one of ordinary skill in the technical field of the present disclosure from the present specification and the accompanying drawings.

BEST MODE

Figure 1:
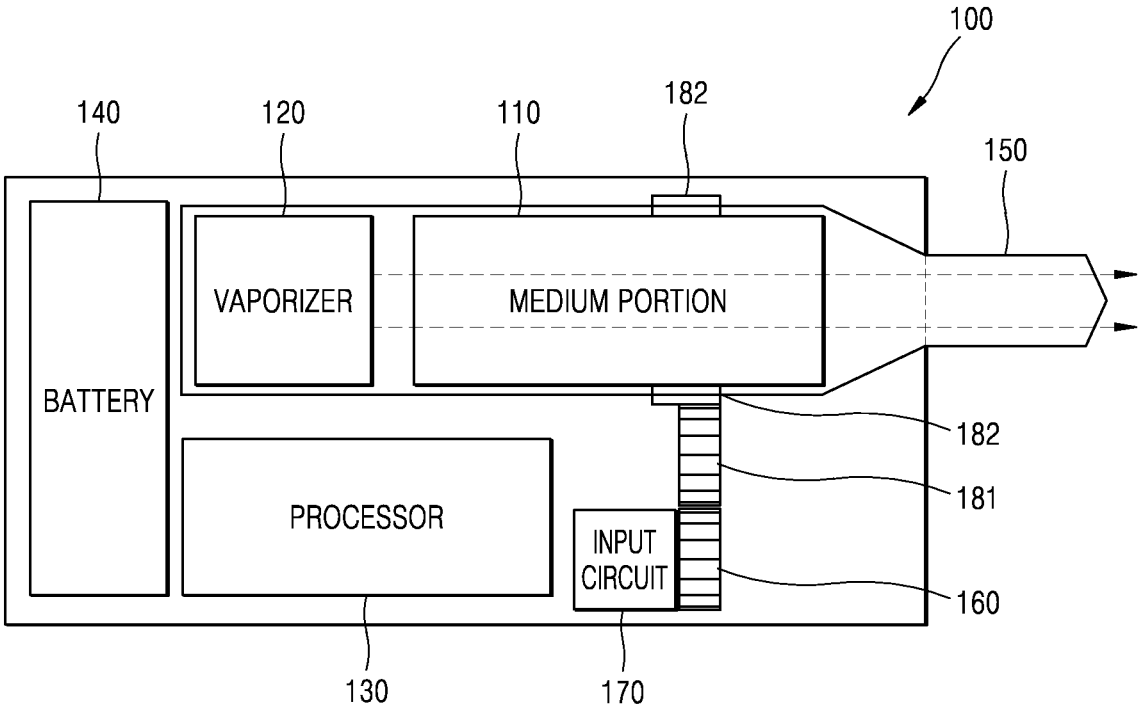
FIG. 1 is a diagram of a configuration of an aerosol-generating apparatus according to an embodiment.

An aerosol-generating apparatus according to an aspect includes: a vaporizer configured to generate an aerosol by heating an aerosol-generating material; a chamber configured to rotate with respect to the vaporizer and store a flavoring material such that the aerosol generated in the vaporizer passes through the flavoring material; an input portion configured rotate according to a user manipulation and cause the chamber to rotate along; an input circuit comprising: a rotating device coupled to the input portion to rotate with the input portion; and a plurality of connecting devices configured to generate a signal based on a position of the rotating device such that one of the plurality of connecting devices corresponding to a position of the rotating device generates a changed signal; and a processor configured to perform a function corresponding to a connecting device that has generated the changed signal among the plurality of connecting devices.

In addition, the changed signal is transmitted to the processor as the rotating device is positioned to correspond to the connecting device, and the processor, based on the changed signal, determines that the connecting device corresponds to a position of the rotating device.

In addition, the aerosol-generating apparatus includes a plurality of chambers which are arranged along a rotation direction.

In addition, the processor determines, among the plurality of chambers, a chamber corresponding the connecting device as a chamber in use.

In addition, the vaporizer is in fluid communication with the chamber in use such that the aerosol passes through the chamber in use.

In addition, the processor controls the vaporizer to be heated according to a temperature profile corresponding to the connecting device.

In addition, the aerosol-generating apparatus further includes a puff sensor configured to detect puffs of a user, and the processor counts a number of puffs with respect to the chamber in use by using the puff sensor.

In addition, the processor, when the counted number of puffs is equal to or greater than a threshold value, limits an operation of the vaporizer with respect to the chamber in use.

In addition, the aerosol-generating apparatus further includes a light-emitting portion configured to emit light, and the processor controls the light-emitting portion such that light corresponding to the connecting device is emitted.

In addition, the aerosol-generating apparatus further includes a vibrator configured to generate vibration, and the processor changes a vibration mode of the vibrator to correspond to the connecting device.

In addition, the aerosol-generating apparatus further includes a memory configured to store information corresponding to each of the plurality of connecting devices, and the processor performs the function based on the information stored in the memory.

In addition, the input portion receives a push input, and the processor performs a function corresponding to the push input.

In addition, the processor initiates preheating or heating of the vaporizer in response to the push input.

In addition, the processor controls the vaporizer to be heated according to a temperature profile corresponding to an intensity of the push input or a number of times of receiving the push input.

In addition, the processor turns on and off the aerosol-generating apparatus in response to the push input.

MODE FOR INVENTION

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

As used herein, terms including an ordinal number such as "first" or "second" may be used to describe various components, but the components should not be limited by the terms. The terms are used only for the purpose of distinguishing one component from other components.

Hereinafter, embodiments of the present disclosure will be described in detail with reference to the drawings.

FIG. 1 is a diagram of a configuration of an aerosol-generating apparatus according to an embodiment.

Referring to FIG. 1, an aerosol-generating apparatus 100 may include a medium portion 110, a vaporizer 120, a processor 130, a battery 140, a mouthpiece 150, an input portion 160, an input circuit 170, a dial gear 181, and a medium portion gear 182.

FIG. 1 only illustrates some components of the aerosol-generating apparatus 100, which are particularly related to the present embodiment. Therefore, it will be understood by one of ordinary skill in the art that other components may be further included in the aerosol-generating apparatus 100, in addition to the components illustrated in FIG. 1.

In addition, an internal structure of the aerosol-generating apparatus 100 is not limited to the diagram shown in FIG. 1. In other words, according to the design of the aerosol-generating apparatus 100, the medium portion 110, the vaporizer 120, the processor 130, the battery 140, the mouthpiece 150, the input portion 160, the input circuit 170, the dial gear 181, and the medium portion gear 182 may be differently arranged. For example, the input circuit 170 is shown as combined with the input portion 160, but may also be combined with the dial gear 181.

The aerosol-generating apparatus 100 according to the embodiment in FIG. 1, which is an apparatus for providing an aerosol to a user, may generate an aerosol by using a resistance heating method, an induction heating method, an ultrasound vibration method, or the like.

The medium portion 110 may include at least one chamber. When the medium portion 110 includes a plurality of chambers, the chambers may be partitioned to be independent of one another by separators. A chamber may store a flavoring material through which the aerosol is to pass. A single chamber and the plurality of chambers will be described in detail later with reference to FIGS. 5A and 5B.

The flavoring material may be in a solid state, and for example, may include a granule, that is, a group of powder or small-sized particles. However, it is not limited thereto.

For example, the flavoring material may be in the form of a capsule, and may also be in the form of chopped plant leaves.

*47The flavoring material may include ingredients that may provide various flavors or savors to the user.

The flavoring material may include, for example, a tobacco-containing material that includes a volatile tobacco-flavored component, additives such as flavors, a wetting agent, and/or organic acid, a flavored material such as menthol or a moisturizer, any one component among plant extract, spices, flavorings, and a vitamin mixture, or a combination thereof.

The spices in the flavoring material may include menthol, peppermint, spearmint oil, and various fruit-flavored ingredients, but are not limited thereto.

The flavoring material may include a vitamin mixture, and vitamin mixture may include at least one of vitamin A, vitamin B, vitamin C, and vitamin E, but are not limited thereto.

The medium portion 110 may be arranged to rotate with respect to the vaporizer 120. When the medium portion 110 includes the plurality of chambers, the chambers may be sequentially arranged apart from one another, in a rotation direction of the medium portion 110.

One or more chambers may be included in the medium portion 110. For example, the medium portion 110 may have a cylindrical shape, and a single cylindrical chamber may be arranged inside the medium portion 110. Alternatively, a plurality of chambers may be arranged on the outside of the medium portion 110. For example, a top surface of the medium portion 110 may be partitioned into four chambers. The medium portion 110 may rotate in a clockwise direction or a counterclockwise direction with respect to a longitudinal-direction axis of the aerosol-generating apparatus 100. As the medium portion 110 rotates, relative positions of the plurality of chambers 110 with respect to the vaporizer 120 may be changed.

The vaporizer 120 may generate an aerosol by heating an aerosol-generating material (for example, a liquid composition), and the generated aerosol may be provided to the user through the chamber of the medium portion 110. When the medium portion 110 includes the plurality of chambers, the aerosol may pass through one of the plurality of chambers. In other words, the aerosol generated by the vaporizer 120 may move along an air flow passage of the aerosol-generating apparatus 100, and the air flow passage may be configured such that the aerosol generated by the vaporizer 120 may be provided to the user through one of the plurality of chambers included in the medium portion 110.

The vaporizer 120 may generate the aerosol by changing a phase of the liquid composition into a gas phase. The aerosol may indicate a mixture of air and particles which are generated by vaporizing the liquid composition.

For example, the vaporizer 120 may include a liquid storage, a liquid delivery element, and a heating element, but it is not limited thereto. For example, the liquid storage, the liquid delivery element, and the heating element may also be included in the aerosol-generating apparatus 100 as independent modules.

The liquid storage may store a liquid composition. The liquid composition may include a material in a liquid state or a gel state. The liquid composition may be maintained, in the liquid storage, in a state of being immersed into a porous material such as sponge or cotton.

For example, the liquid composition may include a liquid including a tobacco-containing material having a volatile tobacco flavor component, or a liquid including a non-tobacco material. The liquid storage may be formed to be attached/detached to/from the vaporizer 120 or may be formed integrally with the vaporizer 120. When the liquid storage is formed integrally with the vaporizer 120, the vaporizer 120 may be combined to the aerosol-generating apparatus 100 to be attachable to/detachable from the aerosol-generating apparatus 100.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol-forming substance, such as glycerin and propylene glycol.

The liquid delivery element may deliver the liquid composition of the liquid storage to the heating element. For example, the liquid delivery element may include a wick such as cotton fiber, ceramic fiber, glass fiber, or porous ceramic, but is not limited thereto.

The heating element is an element for heating the liquid composition delivered by the liquid delivery element. For example, the heating element may include a metal heating wire, a metal hot plate, a ceramic heater, or the like, but is not limited thereto. In addition, the heating element may include a conductive filament such as nichrome wire, may be arranged in contact with the liquid delivery element or adjacent to the liquid delivery element, or may be arranged in a structure of being wound around the liquid delivery element. The heating element may be surrounded by the liquid storage.

The heating element may be heated by a current supply, and may transfer heat to the liquid composition that is in contact with the heating element, thereby heating the liquid composition. However, it is not necessarily limited thereto. The vaporizer 120 may generate the aerosol, for example, by an ultrasound method or an induction heating method.

The vaporizer 120 may be referred to as a cartridge, a cartomizer, or an atomizer, but it is not limited thereto.

The vaporizer 120 and the medium portion 110 may be combined to be rotatable with respect to each other. For example, the vaporizer 120 may be fixed, and the chamber of the medium portion 110 may rotate with respect to the vaporizer 120.

The vaporizer 120 may be arranged to be in fluid communication with one of the chambers such that the aerosol generated from the vaporizer 120 may pass through only one chamber that is in fluid communication with the vaporizer 120, among the plurality of chambers.

The vaporizer 120 may include a discharge port, which extends in a longitudinal direction of the aerosol-generating apparatus 100 and delivers the aerosol to the medium portion 110. The liquid storage included in the vaporizer 120 delivers the aerosol, which is generated by the heating element, to the discharge port. Accordingly, the aerosol provided from the liquid storage is delivered to the medium portion 110 through the discharge port.

While the vaporizer 120 is combined to the medium portion 110, relative positions of the vaporizer 120 and the medium portion 110 may be changed, and thus, different portions of a single chamber of the medium portion 110 may be aligned with the discharge port of the vaporizer 120. Alternatively, as relative positions of the vaporizer 120 and the medium portion 110 are changed, at least one of the plurality of chambers may be aligned with the discharge port of the vaporizer 120. Therefore, the aerosol sent out of the discharge port of the vaporizer 120 passes through a portion corresponding to the discharge port in the single chamber of the medium portion 110, or passes through the flavoring material stored in a chamber corresponding to the discharge port among the plurality of chambers of the medium portion 110. While the aerosol passes through the flavoring material, properties of the aerosol may be changed.

When the discharge port is formed such that the aerosol passes through the bottom surface of the medium portion 110, even when a large amount of flavoring material is included, only a migration amount of the flavoring material may increase and the migration may not continue for a sufficiently long time. Accordingly, the duration of migration of the flavoring material may increase as the discharge port is formed such that the aerosol passes through only a portion of the single chamber. In the case of multiple chambers, as the discharge port is formed such that the aerosol passes through one of the plurality of chambers, the duration of migration of the flavoring material may increase by a factor of the number of the chambers. As the duration of migration of the flavoring material may increase, an amount of the liquid composition that is used with the flavoring material may also increase. Therefore, the flavoring material may continue migration for a long time without the medium portion 110 being replaced. Also, when different portions of the single chamber or the plurality of chambers include different flavoring materials, the flavor of the aerosol may be changed.

The aerosol-generating apparatus 100 may include a mouthpiece 150 to be put in the user's mouth. The aerosol generated from the vaporizer 120 may be sent to the outside of the aerosol-generating apparatus 100 through the mouthpiece 150. In an example, the mouthpiece 150 may be formed at an end portion of the aerosol-generating apparatus 100.

The vaporizer 120, the medium portion 110, and the mouthpiece 150 may be integrally combined to form an aerosol-generating assembly. According to embodiments, the aerosol-generating assembly may have various shapes such as a cuboid or a cube. The aerosol-generating assembly may be detachably combined with the aerosol-generating apparatus 100. When the aerosol-generating assembly is inserted into the aerosol-generating apparatus 100, the aerosol-generating apparatus 100 may generate the aerosol by operating the vaporizer 120. The aerosol generated by the vaporizer 120 is delivered to the user through the medium portion 110.

The processor 130 may generally control operations of the aerosol-generating apparatus 100. In detail, the processor 130 may control not only operations of the battery 140 and the vaporizer 120, but also operations of other components included in the aerosol-generating apparatus 100. Also, the processor 130 may check a state of each of the components of the aerosol-generating apparatus 100 to determine whether the aerosol-generating apparatus 100 is able to operate.

The processor 130 may be implemented as an array of a plurality of logic gates or may be implemented as a combination of a general-purpose microprocessor and a memory in which a program executable in the microprocessor is stored. In addition, it will be understood by one of ordinary skill in the art that implementation in other types is also available.

The battery 140 provides power to be used for the aerosol-generating apparatus 100 to operate. For example, the battery 140 may provide power for the vaporizer 120 to be heated, and may provide power for the processor 130 to operate. Also, the battery 140 may provide power for operations of a display, a sensor, a motor, etc. mounted in the aerosol-generating apparatus 100.

Operations of the input portion 160, the input circuit 170, the dial gear 181, and the medium portion gear 182 will be described later with reference to FIGS. 2 and 3.

Figure 2:
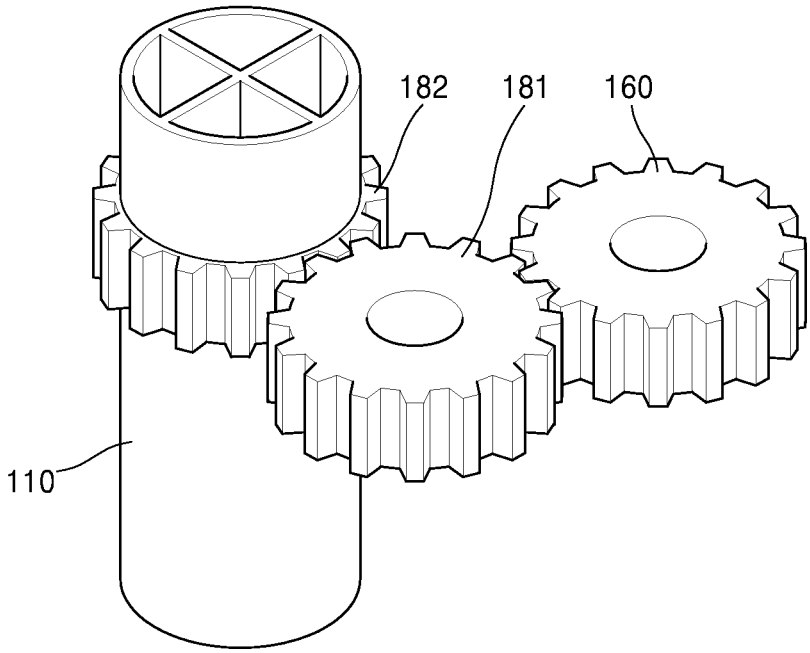
FIG. 2 is a diagram for describing a rotation method of a medium portion according to an embodiment.

FIG. 2 is a diagram for describing a method by which the medium portion according to an embodiment rotates.

Referring to FIG. 2, the medium portion 110, the input portion 160, the dial gear 181, and the medium portion gear 182 are shown. The medium portion 110 in FIG. 2 may correspond to the medium portion 110 in FIG. 1. Therefore, repeated descriptions thereof are omitted.

The input portion 160, the dial gear 181, and the medium portion gear 182 may rotate the plurality of chambers of the medium portion 110 by operating in conjunction with one another.

The dial gear 181 may be engaged with the input portion 160 and the medium portion gear 182, and may deliver rotation energy, which is applied to the input portion 160, to the medium portion gear 182.

The input portion 160 may rotate by the user manipulating the input portion 160 by, for example, a rotation input. A rotation input is a user input for rotating the input portion 160 while maintaining contact with the input portion 160. Thus, a rotation input may be applied from initiation of the rotation of the input portion 160 until release of user contact. The input portion 160 may correspond to, for example, a dial, but is not limited thereto. A portion of the input portion 160 may protrude to the outside of the aerosol-generating apparatus 100. The input portion 160 may be engaged with the dial gear 181, and the rotational force of the input portion 160 may be transferred to the dial gear 181.

The medium portion gear 182 may be arranged to surround the medium portion 110 such that the medium portion 110 rotates along with the medium portion gear 182. The medium portion gear 182 may rotate the single chamber or the plurality of chambers in the medium portion 110. The plurality of chambers may be physically separated from one another by separators. Although it is shown that the medium portion 110 includes four chambers, the number of chambers is not limited thereto.

The input portion 160, the dial gear 181, and the medium portion gear 182 have a sawtooth shape in FIG. 2, the shape is not limited thereto. Also, the dial gear 181, the input portion 160, and the medium portion gear 182 may be arranged in a different manner according to embodiments. In addition, the dial gear 181, the input portion 160, and the medium portion gear 182 may have different numbers of sawteeth, and the numbers of sawteeth may be determined according to a certain ratio. For example, a ratio of the numbers of sawteeth of the input portion 160, the dial gear 181, and the medium portion gear 182 may be 1:2:3, and the numbers of sawteeth of the input portion 160, the dial gear 181, and the medium portion gear 182 may be respectively four, eight, and twelve. However, the number of sawteeth and the ratio of the number of sawteeth are not limited thereto.

Rotation directions of the input portion 160, the dial gear 181, and the medium portion gear 182 may or may not be the same. For example, when the input portion 160 rotates in the clockwise direction, the dial gear 181 may rotate in the counterclockwise direction, and the medium portion gear 182 may rotate in the clockwise direction. However, embodiments are not limited thereto.

At least one of the input portion 160, the dial gear 181, and the medium portion gear 182 may be omitted as necessary. For example, the dial gear 181 and the medium portion gear 182 may be omitted, and the input portion 160 may be directly combined with the medium portion 110 and rotate the medium portion 110. Alternatively, the dial gear 181 may be omitted, the input portion 160 may rotate in response to a rotation input, and the medium portion gear 182 directly engaged with the input portion 160 may rotate the medium portion 110.

The input portion 160, the dial gear 181, and the medium portion gear 182 may include various materials, and may respectively include different materials.

Figure 3:
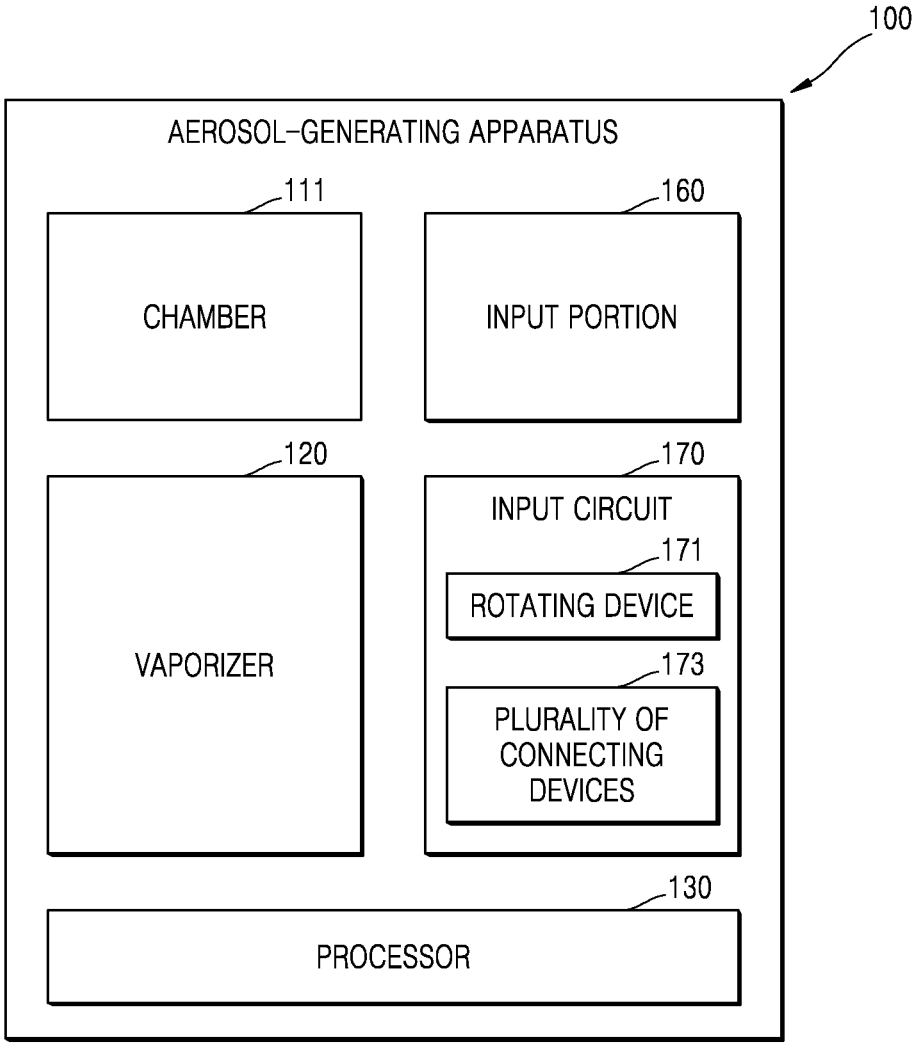
FIG. 3 is a block diagram of a hardware configuration of an aerosol-generating apparatus according to an embodiment.

FIG. 3 is a block diagram of a hardware configuration of an aerosol-generating apparatus according to an embodiment.

Referring to FIG. 3, the aerosol-generating apparatus 100 may include a chamber 111, the vaporizer 120, the input portion 160, the input circuit 170, and the processor 130. The input circuit 170 may include a rotating device 171 and a plurality of connecting devices 173-176. The chamber 111, the input portion 160, and the processor 130 shown in FIG. 3 may correspond to the chamber, the input portion 160, and the processor 130 in FIGS. 1 and 2. Therefore, repeated descriptions thereof are omitted.

FIG. 3 only illustrates some components of the aerosol-generating apparatus 100, which are particularly related to the present embodiment. Therefore, it will be understood by one of ordinary skill in the art that other components may be further included in the aerosol-generating apparatus 100, in addition to the components illustrated in FIG. 3.

The aerosol-generating apparatus 100 may include at least one chamber 111. The chamber 111 may store flavoring materials. When there are multiple chambers 111, the chambers may be connected to one another to form an assembly (for example, the medium portion 110), while being separated by separators (e.g., partition walls).

The input portion 160 may rotate the chamber 111 by a rotating input by the user. The input portion 160 may contact the medium portion 110 or directly contact the chamber 111 and rotate the chamber 111. Alternatively, the input portion 160 may indirectly rotate the chamber 111 through at least one intervening component (for example, the dial gear 181 or the medium portion gear 182) disposed between the input portion 160 and the chamber 111.

The input circuit 170 may be electrically connected to the processor 130, and may transmit a certain signal to the processor 130 in response to rotation of the input portion 160. The input circuit 170 may include the rotating device 171, which is combined with the input portion 160 and rotates along with the input portion 160. The rotating device 171 may be physically or electrically connected to the input portion 160, and may rotate in accordance with the rotation of the input portion 160. The rotating device 171 may correspond, for example, to a device, an electric component, a pin, or the like that is arranged to be rotatable on a surface of the input circuit 170. However, this is merely an example, and the type of the rotating device 171 is not limited thereto.

The input circuit 170 may include a plurality of connecting devices 173-176. The connecting devices 173-176 may be respectively connected to different portions of the processor 130. For example, the different portions of the processor 130, to which the connecting devices 173-176 are respectively connected, may correspond to different circuits, different terminals, different ports (for example, a general-purpose input/output port), or the like.

The connecting devices 173-176 may generate a certain signal and transmit the signal to the processor 130. When the rotating device 171 rotates and therefore is positioned to correspond to one of the connecting devices, a signal generated from the connecting device may be changed. The connecting device may deliver the changed signal to the processor 130.

The processor 130 may receive the changed signal and perform a function corresponding to the connecting device that has generated the changed signal among the connecting devices 173-176. In other words, the processor 130 may perform a function corresponding to a connecting device corresponding to a position of the rotating device 171 among the connecting devices 173-176.

At least one function may correspond to each of the connecting devices 173-176. Alternatively, when there are multiple chambers 111, the connecting devices 173-176 may respectively correspond to the plurality of chambers 111. In this case, the number of the connecting devices 173-176 may correspond to the number of the chambers 111.

The input portion 160 may also receive a push input of the user pushing the input portion 160 in a direction from the outside of the aerosol-generating apparatus 100 toward the inside, just like pushing a button. In this case, the input portion 160 may be configured to receive both the rotation input and the push input. The aerosol-generating apparatus 100 may include a push-pull switch, a tact switch, and the like, which are connected to the input portion 160 to be able to respond to the push input. A tact switch may refer to a switch that may give a 'clicking' contact sense to the user, and may include, for example, a switch that moves while being elastically supported by an elastic element or a dorm-shaped switch that may be elastically transformed.

The processor 130 may perform various functions in response to the push input. For example, the processor 130 may perform different functions based on an intensity of the push input, the number of times of receiving the push inputs, or a combination thereof. Alternatively, the processor 130 may perform a function corresponding to a total number of times of receiving the push inputs during a preset time period (for example, for three seconds) from a time point at which the push input is first received.

The processor 130 may initiate heating or preheating of the vaporizer 120 in response to the push input. Alternatively, the processor 130 may control the vaporizer 120 to be heated according to a temperature profile corresponding to the intensity of the push input, the number of times of receiving the push input, or a combination thereof. For example, the processor 130 may apply a temperature profile of a high temperature when the intensity of the push input is relatively high, and may apply a temperature profile of a general temperature when the intensity of the push input is relatively low. Alternatively, the processor 130 may apply the temperature profile of a high temperature when the push input is received twice during the preset period, and may apply the temperature profile of a general temperature when the push input is received once during the preset period.

The processor 130 may turn on and off the aerosol-generating apparatus in response to the push input. For example, when the push input persists for a certain time period or longer, the processor 130 may turn on or turn off the aerosol-generating apparatus.

In an embodiment, the aerosol-generating apparatus 100 may include a force sensor connected to the input portion 160 to detect the intensity of the push input. The force sensor may sense, for example, an amount of an inductance change of an inner space of the force sensor to detect a pressure applied to the input portion 160.

Figure 4:
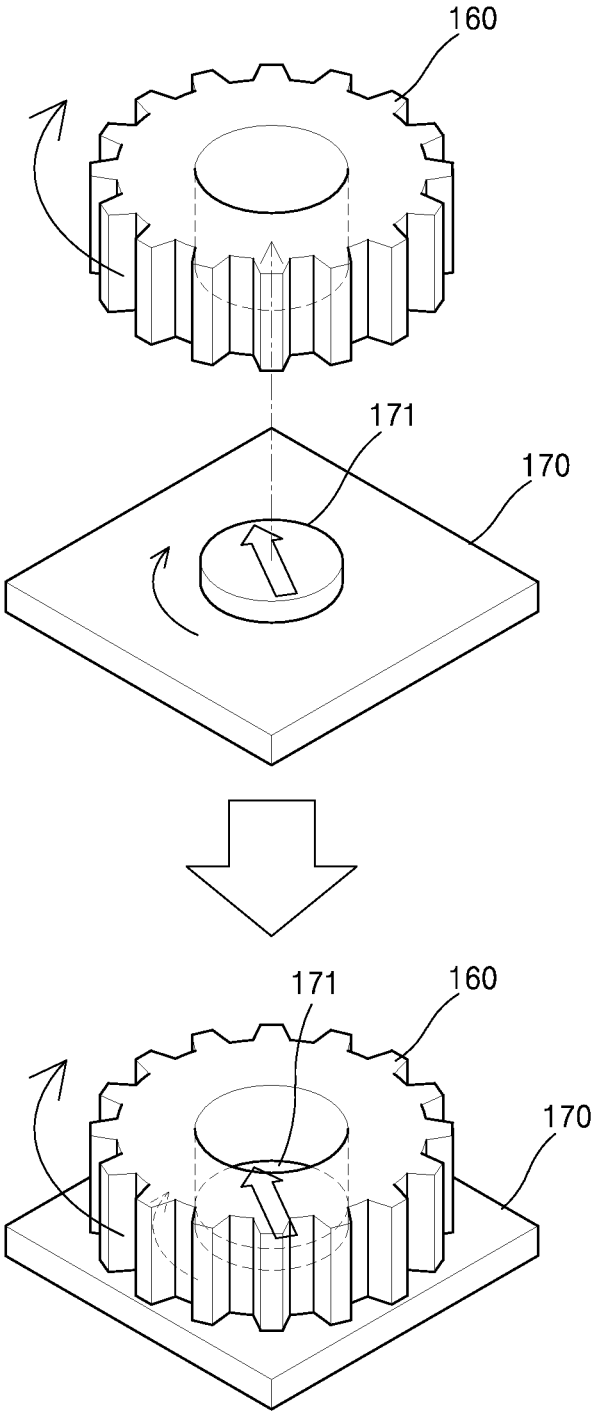
FIG. 4 is a diagram for describing combination of an input portion and a rotating device according to an embodiment.

FIG. 4 is a diagram for describing a combination of the input portion with the rotating device according to an embodiment.

Referring to FIG. 4, the rotating device 171 may be combined with the input portion 160. As the input portion 160 rotates, the rotating device 171 may rotate while the input circuit 170 is fixed.

The input portion 160 and the rotating device 171 may be physically coupled to each other to rotate together. In the embodiment according to FIG. 4, the rotating device 171 may be convexly formed on the substrate of the input circuit 170 and may be inserted into a hole of the input portion 160. Also, a bump may be formed on the rotating device 171, and a groove corresponding to the bump may be formed in the hole of the input portion 160 such that the rotating device 171 may be inserted. Accordingly, the rotating device 171 may rotate along with the input portion 160.

However, a combination of the rotating device 171 with the input portion 160 is not limited to the above-stated example, and may be variously embodied. For example, the rotating device 171 may penetrate the input portion 16 through the hole of the input portion 160. Alternatively, the rotating device 171 may be concavely formed on the substrate of the input circuit 170, and a convex portion corresponding to the rotating device 171 may be formed on the input portion 160 to fit in the rotating device 171, and thus, the rotating device 171 may be combined with the input portion 160.

In an embodiment, the input portion 160 and the rotating device 171 may not be in direct contact, but the input portion 160 and the rotating device 171 may be connected through another component in between. The rotating device 171 may rotate along with the input portion 160 through the intervening component.

In another embodiment, the input portion 160 and the rotating device 171 may be electrically connected to each other. An electric signal may be generated as the input portion 160 rotates, and the electric signal may be provided to the input portion 160. The input circuit 170 may rotate the rotating device 171 based on the electric signal.

A ratio between a rotation angle of the input portion 160 and a rotation angle of the rotating device 171 may be variously set. For example, the rotation angle of the input portion 160 may be set equal to the rotation angle of the rotating device 171, and the input portion 160 and the rotating device 171 may rotate in a ratio of 1:1. However, this is merely an example, and it is not limited thereto.

Figure 5A:
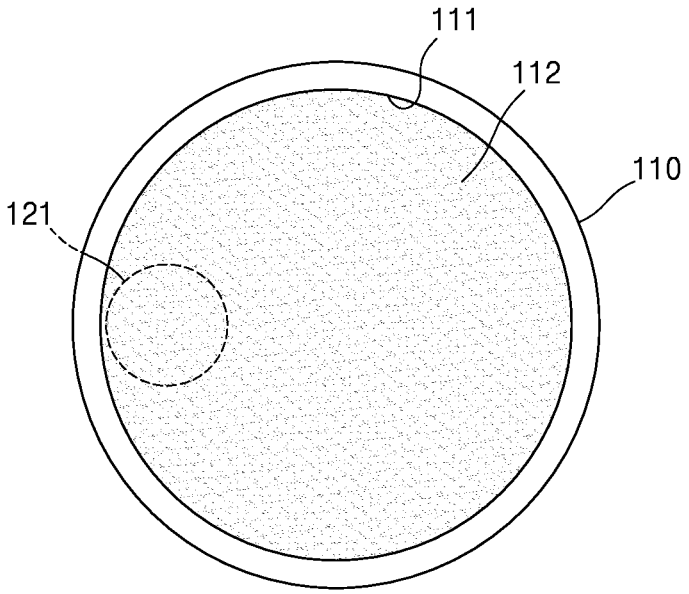
FIG. 5A is a lateral cross-sectional view of a single chamber according to an embodiment.

FIG. 5A is a lateral cross-sectional view of a single chamber according to an embodiment.

Referring to FIG. 5A, the aerosol-generating apparatus 100 may include a chamber 111, and the chamber 111 may store a flavoring material 112.

In FIG. 5A, the chamber 111 surrounds an entire region of the medium portion 110 in a circumference direction, but a structure of the chamber 111 is not limited thereto. For example, the chamber 111 may surround only a partial region of the medium portion 110 in the circumference direction.

As the chamber 111 is rotated by the input portion 160, a relative rotation position thereof with respect to the vaporizer 120 may be changed. A region of the chamber 111 corresponding to a discharge port 121 of the vaporizer 120 may vary according to a rotation position of the chamber 111. The aerosol may pass through a region of the chamber 111 corresponding to the discharge port 121.

Although the chamber 111 is not visually partitioned, the processor 130 may divide the chamber 111 into a plurality of regions in the circumference direction of the medium portion 110, considering an area of the flavoring material 112 corresponding to a size of the discharge port 121. For example, among the plurality of regions of the chamber 111, when the flavoring material 112 in a current region for the aerosol to pass through is exhausted, the processor 130 may align a next region among the plurality of regions with the discharge port 121 by rotating the chamber 111.

Figure 5B:
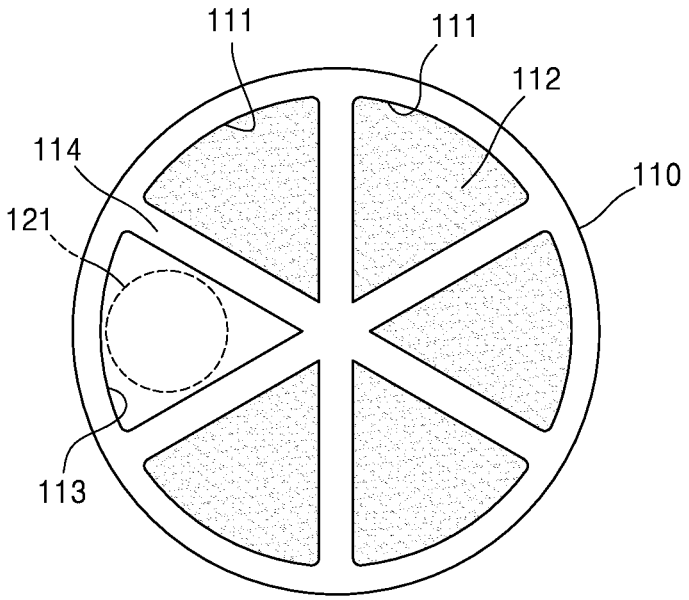
FIG. 5B is a lateral cross-sectional view of a plurality of chambers according to an embodiment.

FIG. 5B is a lateral cross-sectional view of a plurality of chambers according to an embodiment.

Referring to FIG. 5B, the aerosol-generating apparatus 100 may include a plurality of chambers 111 sequentially arranged in a rotation direction, and the chambers 111 may store the flavoring material 112. The chambers 111 may be separated from one another by separators 114 of the medium portion 110.

As the chambers 111 are rotated by the input portion 160, relative positions thereof with respect to the vaporizer 120 may be changed. As shown in FIG. 5B the chambers 111 are aligned such that a position of one of the chambers 111 corresponds to a position of the discharge port 121. A chamber 113 corresponding to the discharge port 121 of the vaporizer 120 may vary according to the positions of the chambers 111.

As the input portion 160 rotates, not only the chambers 111 but also the rotating device 171 may rotate. As the rotating device 171 rotates, a connecting device corresponding to the position of the rotating device 171 may be changed. When the position of the rotating device 171 corresponds to a connecting device, the chamber 113 corresponding to the discharge port 121 may be set as a chamber corresponding to the connecting device. For example, in a case where a first chamber 113 corresponds to the discharge port 121 when the position of the rotating device 171 corresponds to a first connecting device, the first chamber 113 may be set as a chamber corresponding to the first connecting device. Accordingly, the processor 130 may determine the chamber 113 as a chamber in use. In this case, the chamber 113 may be in fluid communication with the vaporizer 120 and the aerosol may pass through the chamber 113.

Figure 6:
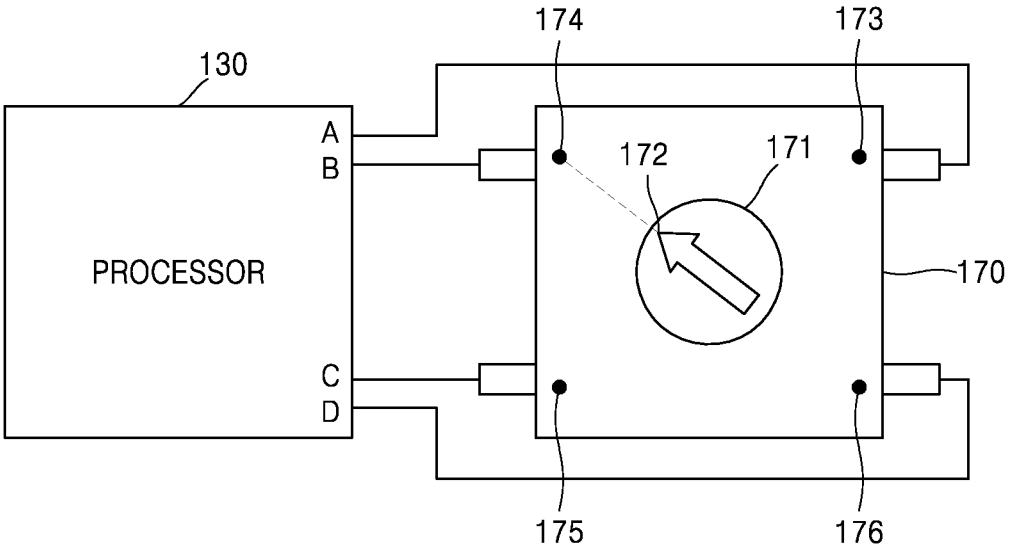
FIG. 6 is a diagram showing connection between an input circuit and a processor, according to an embodiment.

FIG. 6 is a diagram showing connection between the input circuit and the processor, according to an embodiment.

Referring to FIG. 6, the plurality of connecting devices 173-176-176 are connected to different portions A, B, C, and D of the processor 130, respectively, and a reference point 172 of the rotating device 171 may be positioned to correspond to the connecting device 174.

Each of the connecting devices 173-176 may correspond to, for example, an electric device, a common (C) pin, a port, or a switch arranged on the substrate of the input circuit 170, but is not limited thereto.

In an embodiment, the processor 130 may control the battery 140 such that signals having different voltages are applied to the connecting devices 173-176 and the rotating device 171. For example, when the battery 140 applies a signal having a first voltage to the connecting devices 173-176 and applies a signal having a second voltage to the rotating device 171, the signal having the first voltage may be generated in the connecting devices 173-176, and the signal having the second voltage may be generated in the rotating device 171.

In another embodiment, a basic circuit configured to apply the signal having the first voltage may be connected to the connecting devices 173-176, and when the rotating device 171 rotates and thus is positioned to correspond to the connecting device 174 among the connecting devices 173-176 by being electrically connected to the connecting device 174, a voltage of a signal applied to the connecting device 174 may be changed to the second voltage. To this end, the rotating device 171 may include, for example, a resistor, a capacitor, an amplifier, and a semiconductor such as a complementary metal oxide semiconductor (CMOS) or a transistor-transistor logic (TTL).

The processor 130 may detect voltages applied to the connecting devices 173-176 by receiving the signal, which is applied to the connecting devices 173-176, from the connecting devices 173.

When the rotating device 171 is positioned to correspond to one connecting device 174, the rotating device 171 and the connecting device 174 may be connected to each other. In place of the signal that is previously applied, the signal applied to the rotating device 171 may be applied to the connecting device 174 through the rotating device 171. That is, when the rotating device 171 rotates to be aligned with the connecting device 174, a signal generated in the connecting device 174 may be changed. The processor 130 may receive a signal generated from the connecting devices 173-176, and when a changed signal is received, it may determine that the connecting device 174 has generated the changed signal. That is, the processor 130 may receive the changed signal and determine that the connecting device 174 that has generated the changed signal corresponds to the position of the rotating device 171.

When the signal having the first voltage is applied to the connecting devices 173-176 and the rotating device 171 is positioned to correspond to the connecting device 174, a signal applied to the connecting device 174 may be changed from the signal having the first voltage to the signal having the second voltage. For example, when the first voltage is a reference voltage (for example, 3V) and the second voltage is a ground voltage, the signal generated in the connecting device 174 may be changed from a high signal having the reference voltage to a low signal having the ground voltage. The processor 130 may determine a connecting device 174, in which a high signal is detected and then changed into a low signal, as a connecting device 174 corresponding to the position of the rotating device 171, among the connecting devices 173-176. Alternatively, when the first voltage is the ground voltage and the second voltage is the reference voltage, the processor 130 may determine the connecting device 174, in which a signal is changed from a low signal to a high signal, as the connecting device 174 corresponding to the position of the rotating device 171.

The processor 130 may perform a function corresponding to the connecting device 174 among the connecting devices 173-176, which corresponds to the position of the reference point 172 of the rotating device 171. The reference point 172, which is a virtual point on the rotating device 171, may be used to determine which connecting device from among the plurality of connecting devices 173-176 corresponds to the rotating device 171. In FIG. 6, the processor 130 may determine that the connecting device 174 corresponds to a position of the reference point 172 when the rotating device 171 rotated according to a rotation input. The connecting devices 173-176 may transmit different changes to the processor 130 according to the position of the reference point 172.

For example, when a direction toward the reference point 172 from the rotation axis of the rotating axis 171 heads for the position of the connecting device 174, the reference point 172 may be positioned to correspond to the connecting device 174.

When the reference point 172 of the rotating device 171 is positioned to correspond to the connecting device 174 among the plurality of connecting devices 173-176, the processor 130 may perform a function corresponding to the connecting device 174.

In an embodiment, the connecting devices 173-176 may respectively correspond to different chambers 111. The processor 130 may determine, among the plurality of chambers 111, the chamber 113 corresponding to the connecting device 174 as a chamber in use. The chamber in use may be in fluid communication with the vaporizer, and the aerosol generated from the vaporizer may pass through the chamber in use. Also, the chamber in use may be aligned with the discharge port 121 of the vaporizer 120.

In an embodiment, the connecting devices 173-176 may respectively correspond to different temperature profiles. A temperature profile refers to a temperature change of the vaporizer 120 according to time. For example, the temperature profile may refer to a temperature change of the vaporizer 120 during a smoking operation. The processor 130 may control the vaporizer 120 to be heated according to a temperature profile corresponding to the connecting device 174.

In an embodiment, the aerosol-generating apparatus 100 may include a puff sensor configured to detect puffs of the user. The puff sensor may detect change in a pressure or a rate of air that is generated when the user puffs the aerosol. The puff sensor may include a pressure sensor, an air flow rate sensor, and the like.

The processor 130 may count, by using the puff sensor, the number of puffs with respect to the chamber 113 (i.e., chamber in use) corresponding to the connecting device 174. For example, the processor 130 may determine the chamber 113 corresponding to the connecting device 174 as the chamber in use, and may count, by using the puff sensor, the number of puffs in the chamber 113. When the counted number of puffs is equal to or greater than a threshold value, the processor 130 may limit the function corresponding to the connecting device 174. For example, when the function is to heat the vaporizer 120, the processor 130 may limit an operation of the vaporizer 120 with respect to a chamber of which the number of puffs is equal to or greater than the threshold value. As the operation of the vaporizer 120 is limited, a burnt taste or the like is not generated in the aerosol, and satisfaction of the user may increase.

When the counted number of puffs is equal to or greater than the threshold value, the aerosol-generating apparatus 100 may provide a notification to the user by using a light-emitting portion, a display, a speaker, and the like.

In an embodiment, the aerosol-generating apparatus 100 may include the light-emitting portion configured to emit light. The light-emitting portion may emit various colors of light, or may emit light at various cycles, in various brightness, or during various time periods. For example, the light-emitting portion may include a light-emitting diode (LED). However, it is not limited thereto, and may include various configurations emitting light.

The processor 130 may control the light-emitting portion such that light corresponding to the connecting device 174 is emitted. For example, the light-emitting portion may emit pieces of light of different colors for the respective connecting devices 173-176, or may blink each time a connecting device 174 corresponding to the position of the rotating device 171 is changed. Alternatively, the light-emitting portion may emit pieces of light of different brightness or emit light during different time periods for the respective connecting devices 173-176. When the connecting devices 173-176 correspond to different chambers 111, the user may check the chamber in use based on the light emitted from the light-emitting portion.

In an embodiment, the aerosol-generating apparatus 100 may include a vibrator for outputting haptic information. The vibrator may generate vibration at various cycles, various intensities, or during various time periods. As the vibrator vibrates, the aerosol-generating apparatus 100 vibrates, and haptic information may be provided to the user.

The processor 130 may change a vibration mode of the vibrator to correspond to the connecting device 174. For example, the vibrator may vibrate for a preset time period each time the connecting device 174 corresponding to the position of the rotating device 171 is changed. Alternatively, the vibrator may vibrate in different intensities or at different cycles for the respectively connecting devices 174. When the connecting devices 174 correspond to different chambers 111, the user may identify the chamber in use based on the vibration of the vibrator.

In an embodiment, the aerosol-generating apparatus 100 may include a display configured to output visual information. The display may output visual information corresponding to the connecting device 174. For example, the display may output visual information corresponding to the chamber in use. In this case, the user may identify the chamber in use by visual information shown on the display.

In an embodiment, the aerosol-generating apparatus 100 may include a memory configured to store information corresponding to each of the connecting devices 173-176. For example, one memory may store information for each of the connecting devices 173-176 in each of a plurality of regions, or a plurality of memories may each store information for each of the connecting devices 173-176.

The processor 130 may perform a function corresponding to the connecting device 174 based on the information stored in the memory. When the connecting devices 174 correspond to different chambers 111, the memory may individually store an accumulated number of puffs with respect to each of the chambers 111, and the processor 130 may control the operation of the vaporizer 120 based on the accumulated number of puffs with respect to the chamber in use.

Figure 7:
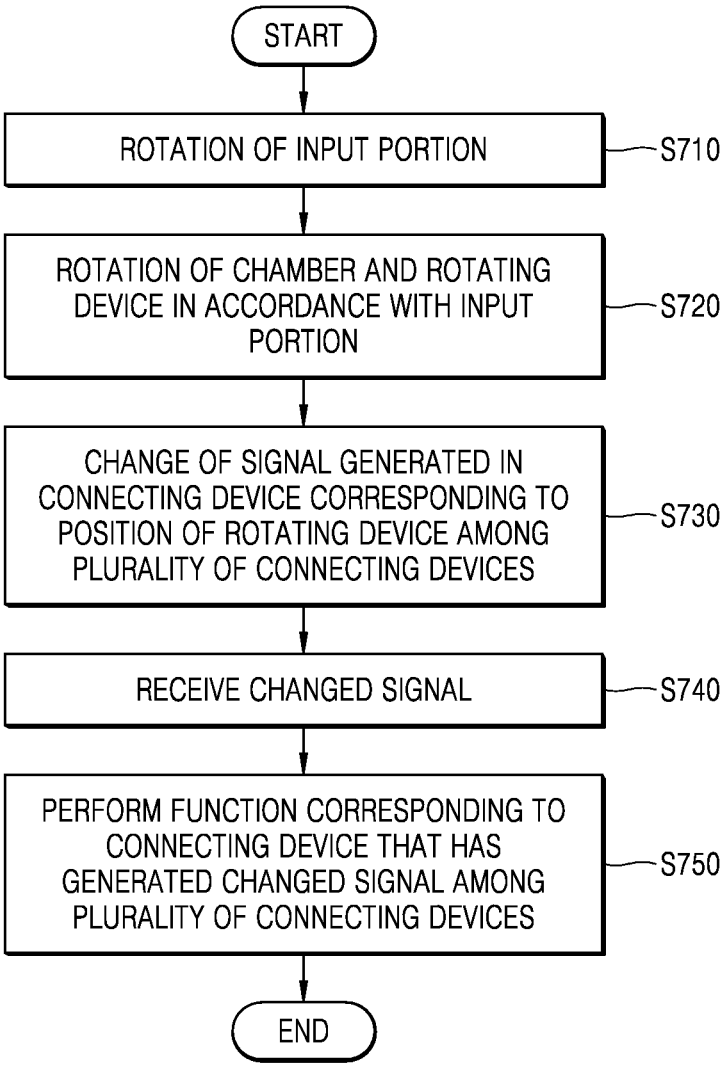
FIG. 7 is a flowchart of an example of an operation method of the aerosol-generating apparatus according to FIG. 3.

FIG. 7 is a flowchart of an example of an operation method of the aerosol-generating apparatus according to FIG. 3.

Referring to FIG. 7, an example of an operation method of the aerosol-generating apparatus 100 includes operations that are processed in the aerosol-generating apparatus 100 shown in FIG. 3. Accordingly, even though omitted below, the foregoing descriptions regarding the aerosol-generating apparatus 100 shown in FIG. 3 may be applied to the operation method of the aerosol-generating apparatus 100 shown in FIG. 7.

In operation S710, the input portion 160 may be rotated by the user.

In another embodiment, the input portion 160 may be pushed by the user, and in this case, the input portion 160 may recognize the push input as well as the rotation input.

In operation S720, the chamber 111 and the rotating device 171 may rotate in accordance with rotation of the input portion 160.

The input portion 160 may rotate the chamber 111 by its rotating movement caused by the user. The chamber 111 may be arranged to rotate with respect to the vaporizer 120 and may store the flavoring material 112 such that the aerosol passes through the flavoring material 112. When there are multiple chambers 111, the plurality of chambers 111 may be sequentially positioned along the rotation direction of the medium portion 110 including the chambers 111. The vaporizer 120 may be arranged in fluid communication with one of the plurality of chambers 111, and may generate the aerosol by heating the aerosol-generating material.

The rotating device 171 may be combined with the input portion 160 such that the rotating device 171 rotates along with the input portion 160.

In operation S730, a signal generated in the connecting device 174 corresponding to the position of the rotating device 171 among the plurality of connecting devices 173-176 may be changed.

The connecting devices 173-176 each may generate a signal. A signal generated by a connecting device 174 which corresponds to the current position of the rotating device 171 among the connecting devices 173-176 may be changed. The connecting device 174 may transmit the changed signal to the processor 130.

In operation S740, the processor 130 may receive the changed signal.

The processor 130 may determine that the connecting device 174 corresponds to the position of the rotating device 171 based on the changed signal.

In operation S750, the processor 130 may perform a function corresponding to the connecting device 174, which has generated the changed signal, among the plurality of connecting devices 173-176.

The processor 130 may determine that a chamber 113 which corresponds to the connecting device 174 corresponding to the position of the rotating device 171 as the chamber in use, from among the plurality of chambers 111. The chamber in use may be in fluid communication with the vaporizer 120 and the aerosol may pass through the chamber in use.

The processor 130 may control the vaporizer 120 to be heated according to a temperature profile corresponding to the connecting device 174 which corresponds to the current position of the rotating device 171.

The processor 130 may count, by using the puff sensor, the number of puffs with respect to the chamber 113 corresponding to the connecting device 174 which corresponds to the current position of the rotating device 171. When the counted number of puffs is equal to or greater than the threshold value, the aerosol-generating apparatus 100 may limit the operation of the vaporizer 120 with respect to the chamber 113 (i.e., chamber in use).

The processor 130 may control the light-emitting portion such that light corresponding to the connecting device 174 that corresponds to the position of the rotating device 171 is emitted.

The processor 130 may change the vibration mode of the vibrator to correspond to the connecting device 174 that corresponds to the position of the rotating device 171.

The processor 130 may perform functions based on information stored in the memory configured to store information corresponding to each of the connecting devices 173-176.

The processor 130 may perform a function corresponding to the push input.

The processor 130 may initiate preheating or heating in response to the push input.

The processor 130 may control the vaporizer 120 to be heated according to a temperature profile corresponding to a combination.

The processor 130 may control the vaporizer 120 to be heated according to a temperature profile corresponding to the intensity of the push input or the number of times of receiving the push input.

The processor 130 may control the power of the aerosol-generating apparatus to be on or off, in response to the push input.

The above-described embodiments may be written as a program executable on a computer, and may be implemented in a general-purpose computer configured to execute the program by using a computer-readable non-transitory recording medium. In addition, a structure of the data used in the above-mentioned embodiments may be recorded in a computer-readable recording medium by using various means. The computer-readable recording medium includes a storage medium such as a magnetic storage medium (for example, ROM, a floppy disk, a hard disk, and the like), an optical reading medium (for example, a CD-ROM, a DVD, and the like)

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol-generating apparatus comprising:

a vaporizer configured to generate an aerosol by heating an aerosol-generating material;

a plurality of chambers configured to rotate with respect to the vaporizer and store a flavoring material such that the aerosol generated in the vaporizer passes through the flavoring material;

an input portion configured to rotate according to a user manipulation and cause the plurality of chambers to rotate along;

an input circuit comprising:

a rotating device coupled to the input portion to rotate with the input portion; and a plurality of connecting devices configured to generate a signal based on a position of the rotating device such that one of the plurality of connecting devices corresponding to a position of the rotating device generates a changed signal; and a processor configured to perform a function corresponding to a connecting device that has generated the changed signal among the plurality of connecting devices, wherein the plurality of chambers are arranged along a rotation direction and partitioned to be independent of one another by separators, and wherein the plurality of connecting devices respectively correspond to the plurality of chambers.

2. The aerosol-generating apparatus of claim 1, wherein the connecting device transmits the changed signal to the processor as the rotating device is positioned to correspond to the connecting device, and the processor, based on the changed signal, determines that the connecting device corresponds to a position of the rotating device.

3. The aerosol-generating apparatus of claim 1, wherein the processor determines, among the plurality of chambers, a chamber corresponding to the connecting device as a chamber in use.

4. The aerosol-generating apparatus of claim 3, wherein the vaporizer is in fluid communication with the one of the plurality of chambers in use such that the aerosol passes through the chamber in use.

5. The aerosol-generating apparatus of claim 1, wherein the processor controls the vaporizer to be heated according to a temperature profile corresponding to the connecting device.

6. The aerosol-generating apparatus of claim 3, further comprising a puff sensor configured to detect puffs of a user, wherein the processor counts a number of puffs with respect to the chamber in use by using the puff sensor.

7. The aerosol-generating apparatus of claim 6, wherein the processor, when the counted number of puffs is equal to or greater than a threshold value, limits an operation of the vaporizer with respect to the chamber in use.

8. The aerosol-generating apparatus of claim 1, further comprising a light-emitting portion configured to emit light, wherein the processor controls the light-emitting portion such that light corresponding to the connecting device is emitted.

9. The aerosol-generating apparatus of claim 1, further comprising a vibrator configured to generate vibration, wherein the processor changes a vibration mode of the vibrator to correspond to the connecting device.

10. The aerosol-generating apparatus of claim 1, further comprising a memory configured to store information about each of the plurality of connecting devices, wherein the processor performs the function based on the information stored in the memory.

11. The aerosol-generating apparatus of claim 1, wherein the input portion receives a push input, and the processor performs a function corresponding to the push input.

12. The aerosol-generating apparatus of claim 11, wherein the processor initiates preheating or heating of the vaporizer in response to the push input.

13. The aerosol-generating apparatus of claim 11, wherein the processor controls the vaporizer to be heated according to a temperature profile corresponding to an intensity of the push input or a number of times of receiving the push input.

14. The aerosol-generating apparatus of claim 11, wherein the processor turns on and off the aerosol-generating apparatus in response to the push input.

* * * * *